US008708706B2

(12) United States Patent
Plante

(10) Patent No.: US 8,708,706 B2
(45) Date of Patent: Apr. 29, 2014

(54) WATER SKIER TRAINING DEVICE AND METHOD OF USING THE SAME

(75) Inventor: Thomas M. Plante, Woodbury, MN (US)

(73) Assignee: Revel Match LLC, St. Paul, MN (US)

( * ) Notice: Subject to any disclaimer, the term of this patent is extended or adjusted under 35 U.S.C. 154(b) by 221 days.

(21) Appl. No.: 13/198,948

(22) Filed: Aug. 5, 2011

(65) Prior Publication Data

US 2012/0034585 A1 Feb. 9, 2012

Related U.S. Application Data

(60) Provisional application No. 61/371,471, filed on Aug. 6, 2010.

(51) Int. Cl.
*A63B 69/18* (2006.01)

(52) U.S. Cl.
USPC ..... 434/253

(58) Field of Classification Search
USPC ..... 434/253
See application file for complete search history.

(56) References Cited

U.S. PATENT DOCUMENTS

| | | | | |
|---|---|---|---|---|
| 2,628,274 | A * | 2/1953 | Homrighous | 348/24 |
| 3,156,935 | A * | 11/1964 | Long | 441/72 |
| 3,358,304 | A | 12/1967 | Esmay | |
| 4,031,583 | A * | 6/1977 | Phillips, II | 114/362 |
| 4,595,195 | A * | 6/1986 | Miehlich | 482/71 |
| 4,606,728 | A * | 8/1986 | Simpson | 441/66 |
| 4,779,555 | A * | 10/1988 | Hong | 114/345 |
| 4,865,572 | A * | 9/1989 | Andes | 441/72 |
| 5,713,773 | A * | 2/1998 | Churchill | 441/66 |
| 5,911,611 | A * | 6/1999 | Saad | 441/73 |
| 6,306,000 | B1 * | 10/2001 | Parten et al. | 441/65 |
| 6,386,932 | B1 * | 5/2002 | Murphy | 441/66 |
| 6,582,264 | B2 * | 6/2003 | Brown | 441/40 |
| 6,868,799 | B2 * | 3/2005 | Wright | 114/343 |
| 7,255,057 | B2 * | 8/2007 | Wright | 114/362 |
| 7,444,954 | B1 * | 11/2008 | Resta | 114/362 |
| D621,897 | S * | 8/2010 | Churchill et al. | D21/801 |
| 7,832,348 | B2 * | 11/2010 | Newcomb | 114/248 |

(Continued)

FOREIGN PATENT DOCUMENTS

FR 1022518 3/1953

OTHER PUBLICATIONS

Overton's Inc., EZ Ski Trainer catalog literature, p. 234 (2010).

(Continued)

*Primary Examiner* — Kurt Fernstrom
*Assistant Examiner* — Dolores Collins
(74) *Attorney, Agent, or Firm* — Daniel A. Rosenberg; Briggs and Morgan, P.A.

(57) ABSTRACT

A floatable skier training device that includes a first floatable support comprising a first leading end and a second end, a second floatable support a first leading end and a second end, a seat (e.g., an arcuate seat) extending from the first floatable support to the second floatable support, the arcuate seat having a first forward section, a second rearward section, a top and a bottom, when the device is placed on a body of water, the bottom forms an angle with the surface of the body of water that is no greater than 45 degrees, and a method of using the same to allow a user to start from a position above the water.

25 Claims, 3 Drawing Sheets

(56) References Cited

U.S. PATENT DOCUMENTS

| | | | | |
|---|---|---|---|---|
| 8,025,541 | B2 * | 9/2011 | Churchill et al. | 441/40 |
| 2003/0230227 | A1 * | 12/2003 | Wright | 114/343 |
| 2005/0160962 | A1 * | 7/2005 | Wright | 114/362 |
| 2006/0110716 | A1 * | 5/2006 | Micari et al. | 434/253 |
| 2010/0105263 | A1 * | 4/2010 | Churchill et al. | 441/72 |
| 2011/0269107 | A1 * | 11/2011 | Coleman et al. | 434/253 |
| 2012/0270194 | A1 * | 10/2012 | Kuijpers | 434/253 |

OTHER PUBLICATIONS

Overton's Inc., EZ Ski Trainer catalog literature, back cover page (2009).

* cited by examiner

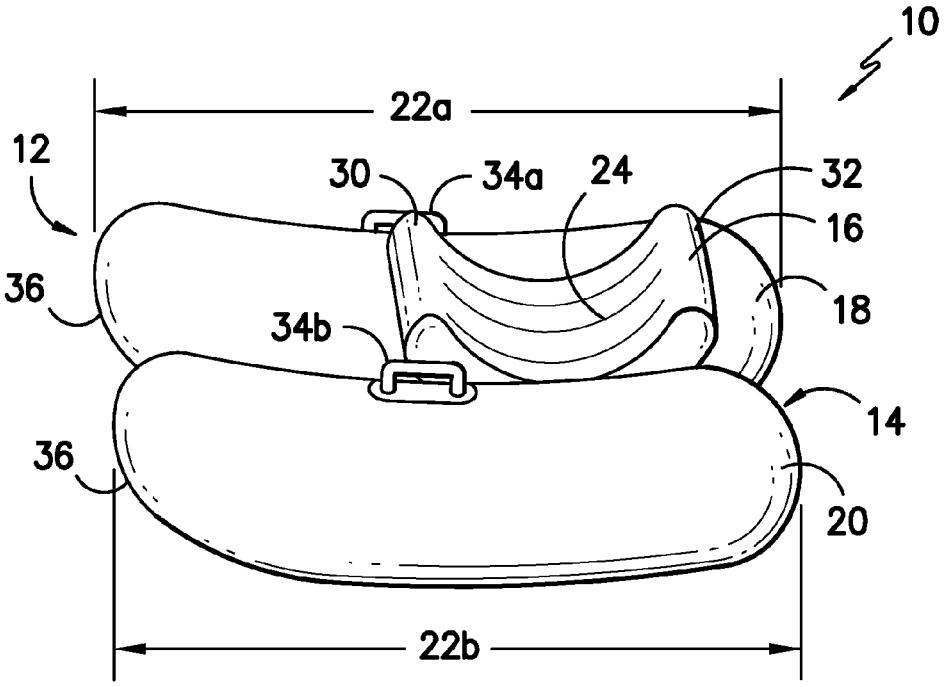
FIG. —1—
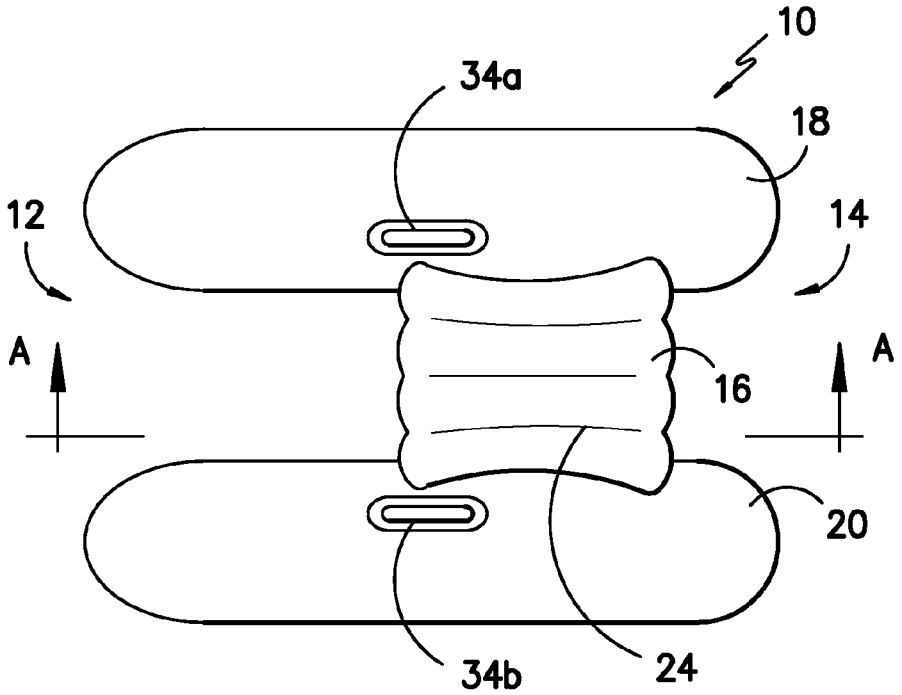
FIG. —2—

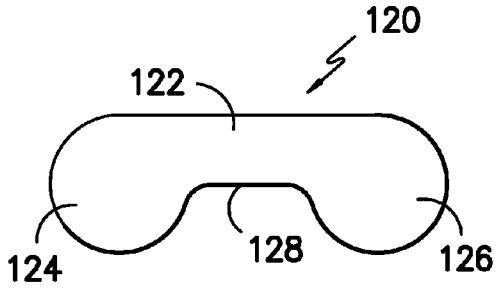
FIG. –6–
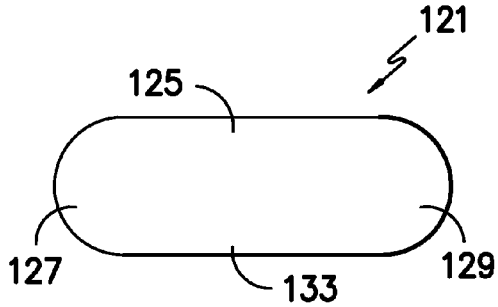
FIG. –7A–
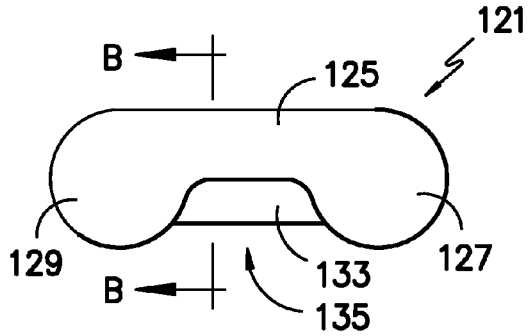
FIG. –7B–
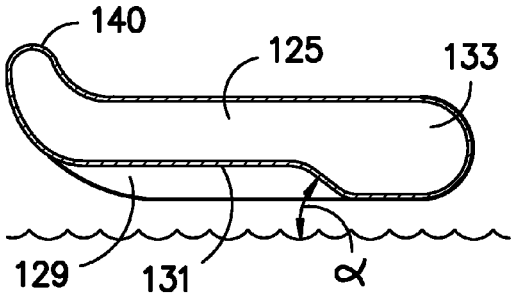
FIG. –8–
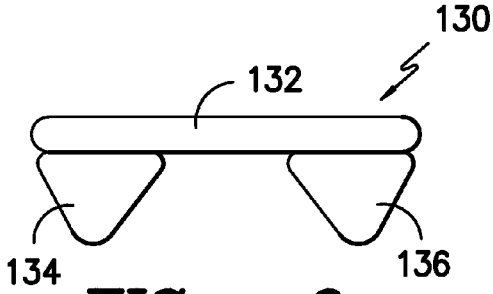
FIG. –9–
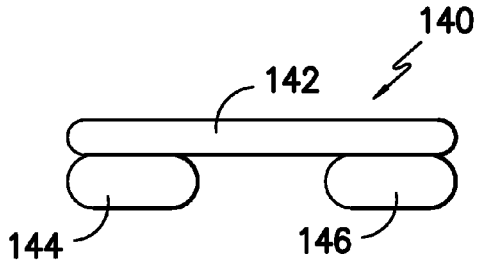
FIG. –10–
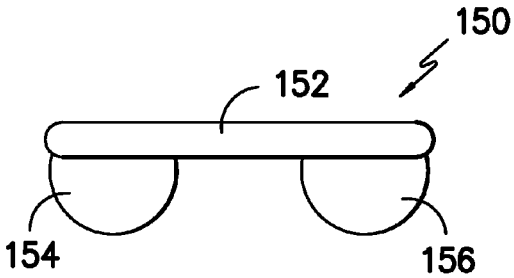
FIG. –11–

WATER SKIER TRAINING DEVICE AND METHOD OF USING THE SAME

CROSS-REFERENCE TO RELATED APPLICATIONS

This application claims the benefit of U.S. Provisional Application No. 61/371,471 filed Aug. 6, 2010, which is incorporated herein.

BACKGROUND

The invention relates to learning how to water ski.

In water skiing, it is very difficult for a beginner to learn to water ski, because most beginners use a deep water start. The phrase "deep water start" refers to a way in which a water skier starts skiing from a position in which the majority of the skier's body and the skier's skis are under water, and the skis are positioned nearly vertically in the water. In order to ski, the skier must transition the skis from this vertical orientation to an orientation in which the skis are parallel with the surface of the water (planed out), and the skier must stand upright above the water on the skis. This transition from down in the water to on top of the water is not only difficult to master, but is also physically tiring. In addition, in the deep water position the skier's skis must be kept upright and parallel to each other, and the skier's ski tips must be kept out of the water during the entire transition from the underwater position to the upright skiing position. Failure to achieve these objectives usually results in either a face plant (i.e., the skier falls face down into the water) or failure to launch (e.g., the skier is dragged underwater), both of which are quite unpleasant.

To assist first time skiers in this process, it is common for a parent or an experienced water skier to stand in shallow water (usually less than 5 feet in depth) and hold the novice skier in position as the boat begins to pull the skier forward. Rarely does the novice skier get up on his or her first attempt; usually it takes many attempts to master the technique. By the time a novice skier has failed a few times, the skier has usually travelled a distance in the water such that the depth of the water in which the skier is located is too deep for another person to provide assistance to the skier. As a result, the skier must attempt to start without assistance. Such attempts are often futile. At this point, the skier frequently gives up.

Various devices are marketed as useful for training novice water skiers. One device is an inflatable, towable craft. The skier is supposed to stand on the craft and be towed in an upright position. These training devices do not allow the skier to wear actual water skis or a wakeboard while standing on the craft, and there is no space to accommodate skis or a wakeboard. As a result, such devices do not ultimately teach the skier how to ski, but merely allow the skier to experience the balance required to remain standing while being towed across a body of water on an inflatable craft.

The present inventors have discovered a need for a process that makes learning to water ski easier using actual water skis or a wakeboard.

SUMMARY

In one aspect, the invention features a floatable skier training device that includes a first floatable support that includes a first leading end and a second end, a second floatable support that includes a first leading end and a second end, an arcuate seat extending from the first floatable support to the second floatable support, the arcuate seat having a first forward section, a second rearward section, a top and a bottom, and the top exhibiting a concave shape, when the device is placed on a body of water, the bottom forms an angle with the surface of the body of water that is no greater than 45 degrees. In one embodiment, when the device is placed on a body of water, the bottom forms an angle with the surface of the body of water that is no greater than 40 degrees. In another embodiment, when the device is placed on a body of water, the bottom forms an angle with the surface of the body of water that is no greater than 35 degrees. In some embodiments, when the device is placed on a body of water, the bottom forms an angle with the surface of the body of water that is no greater than 30 degrees.

In other embodiments, the first and second floatable supports are cylindrical. In another embodiment, the first and second floatable supports are rectangular.

In some embodiments, the first and second floatable supports are inflatable. In other embodiments, the first floatable support, the second floatable support and the seat are separately inflatable.

In one embodiment, the seat is inflatable and comprises baffles defining chambers within the inflatable seat.

In another embodiment, first and second floatable supports include a cylindrical shape and form an arc near the first end.

In some embodiments, further include a saddle horn extending from the arcuate seat.

In one embodiment, the first and second floatable supports are in a fixed relationship to each other and at a fixed distance from each other, the distance between the first floatable support and the second floatable support being less than four feet. In other embodiments, the first and second floatable supports are in a fixed relationship to each other and at a fixed distance from each other, the distance between the first floatable support and the second floatable support being less than three feet. In another embodiment, the first and second floatable supports are in a fixed relationship to each other and at a fixed distance from each other, the distance between the first floatable support and the second floatable support being no greater than 24 inches.

In one embodiment, the first and second floatable supports each have a longitudinal extent and the arc of the seat is in parallel with the greatest longitudinal extent of the first and second floatable supports. In another embodiment, the arcuate seat defines an arc having an axis, the first and second floatable supports each have a longitudinal extent and the axis of the arc of the seat is perpendicular to the greatest longitudinal extent of the first and second floatable supports.

In another aspect, the invention features an inflatable, floatable skier training device that includes a first floatable support comprising a first leading end and a second end, a second floatable support that includes a first leading end and a second end, a seat extending from the first floatable support to the second floatable support, the seat having a first forward section, a second rearward section, a top and a bottom, the bottom extending at an angle from the rearward section toward the forward section, when placed on a body of water, the bottom forms an angle with the surface of the body of water that is no greater than 45 degrees. In one embodiment, the seat defines a substantially planar platform. In another embodiment, the seat is inflatable and comprises baffles which at least partially define chambers within the inflatable seat.

In other aspects, the invention features a method of teaching a water skier to water ski, the method including positioning the skier on the seat of a ski training device such that the skier's legs extend over a forward section of the seat of a water ski training device disclosed herein. In one embodiment, the skier is wearing at least one ski device, and the method further includes positioning the at least one ski device under the seat of the device, positioning a tow rope attached to a boat in the hands of the skier, and pulling the skier with the tow rope with sufficient force such that the skier is able to stand up on the ski device and release from the training device.

The invention features a device that assists a novice water skier in learning how to water ski. The device enables a novice skier to start water skiing in any depth of water without any assistance. The device also enables a novice skier to feel more comfortable learning to water ski since he or she starts above the water, not below it.

Other features and advantages will be apparent from the following description of the drawings, the preferred embodiments, and from the claims. In the figures, like numbers are used to represent like elements.

BRIEF DESCRIPTION OF THE DRAWINGS

FIG. 1 is a perspective view of a skier training device.

FIG. 2 is a top view of the device of FIG. 1.

FIG. 6 is a front view of a water skier training device according to a second embodiment.

FIG. 7A is a back view of a water skier training device according to a third embodiment.

FIG. 7B is a front view of the water skier training device of FIG. 7A.

FIG. 8 is a view taken in cross section along line B-B of the seat of the water skier training device of FIG. 7B.

FIG. 9 is a water skier training device according to a fourth embodiment.

FIG. 10 is a water skier training device according to a fifth embodiment.

FIG. 11 is a water skier training device according to a sixth embodiment.

GLOSSARY

In reference to the invention, these terms have the meanings set forth below:

The phrase "water ski device" refers to a water ski, a wakeboard, a surfboard, and combinations thereof.

DETAILED DESCRIPTION

Figure 3:
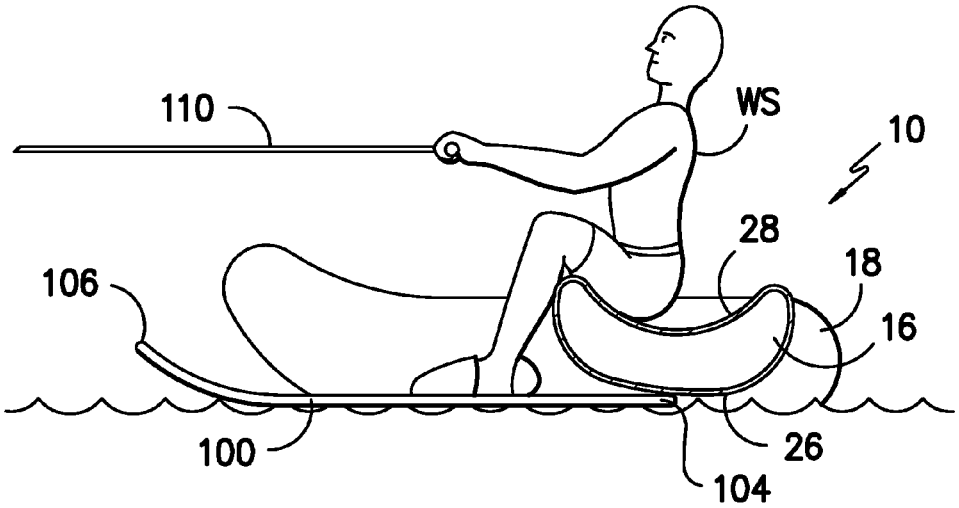
FIG. 3 is a cut away view taken along line A-A of FIG. 2, with a skier positioned in a seated position on the device.
Figure 4:
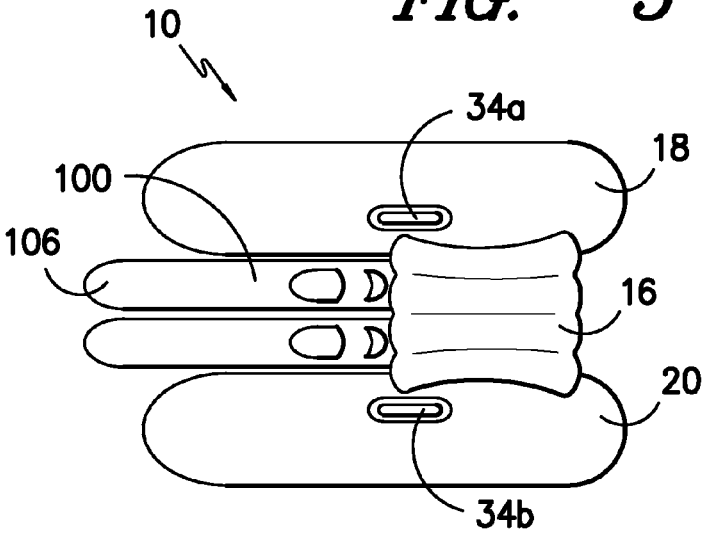
FIG. 4 is a top view of the device of FIG. 1 with two skis positioned between the two floatable supports and partially under the seat.
Figure 5:
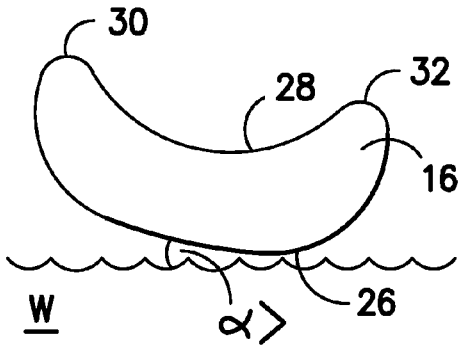
FIG. 5 is a view of the seat of the device of FIG. 1 positioned on a body of water.

Referring to FIGS. 1-5, the inflatable, floatable skier training device 10 is designed to allow a water skier (WS) to sit in the seat 16 of the device 10 such that the back ends 104 of the skier's water skis 100 are positioned underneath the seat 16 and in the water underneath the seat 16 and the front end 106 or tips of the skis 100 are positioned in front of the skier, between the two floatable supports 18, 20, and on the surface of the water (w). The skier positions the skis 100 parallel to one another. A major portion of each ski 100 can sit on the surface of the water (w) when the skier (WS) is sitting on the seat 16.

The skier is given a tow rope 110, which is attached to a boat or other watercraft (not shown). When the boat travels forward, the skier will be towed behind the boat, and when the skier is ready, he or she indicates the same to the driver of the boat and, when the boat is traveling at an appropriate speed, the skier can stand up and immediately start skiing. The device 10 allows the skier to start from a seated position above the water, as opposed to starting from underneath the water, e.g., a deep water start.

Referring to the inflatable, floatable skier training device 10 in nautical terms, the device 10 includes a forward or bow region 12, and a rearward or stern region 14, as illustrated in FIGS. 1-4. An arcuate inflatable seat 16 extends from a first inflatable floatable support 18 to a second inflatable floatable support 20, each of which has a longitudinal extent 22*a*, 22*b* extending from the bow 12 of the device 10 to the stern 14 of the device 10 and handles 34*a*, 34*b*. The seat 16 is positioned closer to the stern 14 of the device 10 relative to the bow 12.

The seat 16 includes a top 28, a bottom 26, a forward region 30, and a rearward region 32. The seat 16 is inflatable and preferably includes baffles 24 extending across the interior body of the inflatable seat 16 from the interior of the bottom of the seat 26 to the interior of the top 28 of the seat 16. The baffles 24 at least partially define chambers within the inflatable seat 16. The top 28 of the seat 16 defines a concave shape terminating in a forward region 30 and a rearward region 32. The concave shape is defined by an arc having a radial depth of at least 2 inches relative to the top of the front portion of the seat. The portions of the arc on each side of the peak can be mirror images of each other, or different from one another.

The forward region 30 of the seat 16 is designed to allow a user's legs to hang over the same when the user is seated on the seat 16 facing the bow 12 or leading edge of the device 10. The forward region 30 of the seat 16 extends upwardly (i.e., away from the surface of the water when the device is positioned on a body of water) to assist in creating resistance against the person sitting on the seat, which assists in maintaining the skier in the seat 16 when towing is initiated so that the skier is not pulled off the seat 16 before being ready to stand up and begin skiing. The rearward region 32 of the seat 16 can also extend upwardly (i.e., away from the surface of the water when the device is positioned on a body of water) to serve as a partial backrest. Alternatively, the rearward region 32 of the seat 16 is flat.

The forward region of the bottom 26 of the seat 16 forms an angle (a) to the surface of a body of water (w) when the inflated device 10 is placed on the body of water w. The angle $\alpha$ preferably is less than 45 degrees, less than about 40 degrees, less than about 35 degrees, or even about 30 degrees. When a skier of relatively lighter weight (e.g., a child) is seated in the seat 16, the seat 16 may not contact the surface of the water, but skiers of relatively heavier weight (e.g., an adult) will likely cause the bottom 26 of the seat 16 to contact or sit at least partially in the water. The angle $\alpha$ formed by the bottom 26 of the seat 16 assists in reducing the amount of drag or friction created by the seat 16 and skier when the device is in motion and the skier is sitting on the seat 16.

The floatable supports 18, 20 have a longitudinal extent 22*a*, 22*b* extending from the bow 12 of the device 10 to the stern 14 of the device 10 and are positioned a distance apart from one another to accommodate the water ski device of a skier. Suitable distances between the floatable supports include of at least 12 inches, at least about 15 inches, at least about 20 inches, no greater than about 40 inches, no greater than about 36 inches, no greater than about 24 inches, or even from about 15 inches to about 30 inches. The floatable supports 18, 20 generally exhibit a cylindrical shape and terminate in an upturn 36 at the bow 12 of the device 10. Alternatively, the floatable supports can exhibit any suitable shape including, e.g., spherical, cylindrical (e.g., pontoons), relatively flat polyhedron (e.g., square and rectangular), pyramidal, prismatic, and combinations thereof, and preferably include an upward sloping bow end.

The floatable supports 18, 20 and seat 16 can be of a variety of constructions including, e.g., multiple chambers in fluid communication with each other with a single inflation valve, individual inflatable chambers each having a separate valve for inflation, and combinations thereof.

The inflatable components of the device can be made from any suitable material including, e.g., thermoplastic polymer (e.g., polyvinyl chloride, rubber, and polyolefin), thermoplastic resin impregnated woven webs including, e.g., polyvinyl impregnated woven webs, polyurethane impregnated woven webs, and combinations thereof. The woven webs can be made from a variety of materials including, e.g., nylon, polyethylene, polyester, and combinations thereof. The tube material can include a woven web of polyester coated (e.g., impregnated) on two major surfaces with a polymer composition, e.g., polyvinyl chloride, to render the material air tight.

The inflatable components can also be of a construction that includes a thermoplastic polymer bladder enveloped in a cover, e.g., a woven web, a coated woven web, and combinations thereof.

The inflatable components of the device can be made from materials or sheets of materials that are capable of being bonded to each other through welding, e.g., thermal welding and sonic welding, through adhesive compositions, and combinations thereof.

Other embodiments are within the claims. Although the device has been described as inflatable, any component of the device could be made from any buoyant or floatable material including, e.g., closed cell foam, wood, and combinations thereof. In addition, although the seat has been described as arcuate, the seat could alternatively be substantially planar, optionally with a saddle horn (e.g., an inflatable or rigid saddle horn) extending from the seat to assist in maintaining an individual on the seat while being towed across a body of water.

Although the device has been described with reference to a water skier and two water skis, the device could be used to start a user of a variety of water enjoyment devices including, e.g., a slalom skier, a wake boarder, a surfer, and a barefoot water skier. Although the water skier has been described as wearing at least one water ski, the skier could also wear any suitable water ski device including, e.g., water skis, a wakeboard, and a surf board.

FIG. 6 illustrates an embodiment of the skier training device 120 that is in the form of an inverted U-shaped construction in which the top 122 of the U forms the seat 122 and the legs 124, 126 of the U form the two floatable supports 124, 126.

FIGS. 7A, 7B and 8 illustrate an embodiment of the skier training device 121 that is in the form of an inverted partially U-shaped construction in which the top 125 of the U forms the seat 125, and the legs 127, 129 of the U form the two floatable supports 127, 129. The device 121 is continuous in the back (i.e., as a partial donut), which creates a back wall 133 to the opening 135 under the seat 125 area. The bottom 131 of the seat 125 forms an angle $\alpha$ with the surface of a body of water. The seat 125 includes a forward section 140 that rises in an upward direction from the base of the seat 125. The forward section 140 is configured to assist in creating resistance against a skier sitting on the seat 125, which assists in maintaining the skier in the seat when towing is initiated so that the skier is not pulled off the seat 125 before he or she is ready to stand up and begin skiing.

FIGS. 9-11 illustrate other generally inverted U-shaped embodiments of the skier training device. Referring to FIG. 9, the device 130 includes a seat 132 extending across to generally prismatic-shaped supports 134, 136. Referring to FIG. 10, the device 140 includes a seat 142 extending across two generally rectangular cubic-shaped supports 144, 146. Referring to FIG. 11, the device 150 includes a seat 152 extending across two generally arcuate-shaped supports 154, 156.

What is claimed is:

1. A floatable skier training device comprising: a first floatable support comprising a first leading end and a second end; a second floatable support comprising a first leading end and a second end; an arcuate seat extending from the first floatable support to the second floatable support, the arcuate seat having a first forward section, a second rearward section, a top and a bottom, and the top exhibiting a concave shape, when the device is placed on the surface of a body of water, the bottom of the seat forms an angle with the surface of the body of water that is no greater than 45 degrees.

2. The device of claim 1, wherein when the device is placed on a body of water, the bottom of the seat forms an angle with the surface of the body of water that is no greater than 40 degrees.

3. The device of claim 1, wherein when the device is placed on a body of water, the bottom forms an angle with the surface of the body of water that is no greater than 35 degrees.

4. The device of claim 1, wherein when the device is placed on a body of water, the bottom forms an angle with the surface of the body of water that is no greater than 30 degrees.

5. The device of claim 1, wherein the first and second floatable supports are cylindrical.

6. The device of claim 1, wherein the first and second floatable supports are rectangular.

7. The device of claim 1 further comprising a bow and a stern, the seat being positioned closer to the stern relative to the bow.

8. The device of claim 1, wherein the forward section of the seat extends in an upward direction.

9. The device of claim 8, wherein the rearward section of the seat extends in an upward direction.

10. The device of claim 1, wherein the first floatable support comprises a cylindrical shape and an arc near the first end, and the second floatable supports comprises a cylindrical shape and an arc near the first end.

11. The device of claim 1 further comprising a saddle horn extending from the arcuate seat.

12. The device of claim 1, wherein the first and second floatable supports are in a fixed relationship to each other and at a fixed distance from each other, the distance between the first floatable support and the second floatable support being less than four feet.

13. The device of claim 1, wherein the first and second floatable supports are in a fixed relationship to each other and at a fixed distance from each other, the distance between the first floatable support and the second floatable support being less than three feet.

14. The device of claim 1, wherein the first and second floatable supports are in a fixed relationship to each other and at a fixed distance from each other, the distance between the first floatable support and the second floatable support being no greater than 24 inches.

15. The device of claim 1, wherein the arcuate seat defines an arc having an axis, the first and second floatable supports each have a longitudinal extent and the axis of the arc of the seat is perpendicular to the greatest longitudinal extent of the first and second floatable supports.

16. An inflatable, floatable skier training device comprising: a first floatable support comprising a first leading end and a second end; a second floatable support comprising a first leading end and a second end; and a seat extending from the first floatable support to the second floatable support, the seat having a forward section, a rearward section, a top and a bottom, the bottom of the seat extending at an angle to a surface of a body of water when the device is placed on the surface, such that the rearward section of the seat is relatively closer to the surface of the body of water and the forward section of the seat is relatively farther from the surface of the body of water, the forward section being configured to create resistance against a user when the user is in position on the seat and towing of the device is initiated.

17. A method of teaching a water skier to water ski, the method comprising: positioning the skier on the seat of a ski training device that is positioned on a surface such that the skier's legs extend over a forward section of an arcuate seat of the ski training device, the ski training device comprising a first floatable support comprising a first leading end and a second end, a second floatable support a first leading end and a second end, the arcuate seat extending from the first floatable support to the second floatable support, the arcuate seat comprising the first forward section, a second rearward section, a top, and a bottom, the top exhibiting a concave shape, and the bottom of the seat extending at an angle from the rearward section of the seat toward the forward section seat such that the bottom defines an angle with the surface that is no greater than 45 degrees.

18. The method of claim 17, wherein the skier is wearing at least one ski device, the method further comprising positioning the at least one ski device under the seat of the ski training device; positioning a tow rope attached to a boat in the hands of the skier; and pulling the skier with the tow rope with a force sufficient to enable the skier to rise and leave the ski training device.

19. An inflatable, floatable skier training device comprising: a first floatable support comprising a first leading end and a second end; a second floatable support comprising a first leading end and a second end; and a seat extending from the first floatable support to the second floatable support, the seat having a first forward section, a second rearward section, a top and a bottom, the bottom of the seat extending at an angle from the rearward section toward the forward section such that when the device is placed on a body of water, the bottom forms an angle with the surface of the body of water that is no greater than 45 degrees.

20. The device of claim 19, wherein the seat defines a substantially planar platform.

21. The device of claim 19, wherein the seat is inflatable and comprises baffles which at least partially define chambers within the inflatable seat.

22. A method of teaching a user to use a water ski device, the method comprising: positioning the user on the seat of the ski training device of claim 16, which is positioned on a surface of a body of water, such that the users legs are positioned over the forward section of the seat of the skier training device.

23. The method of claim 22, wherein the user is wearing the water ski device, the method further comprising positioning the water ski device on the surface of the body of water.

24. A method of teaching a user to use a water ski device, the method comprising: positioning the user on the seat of the ski training device of claim 19, which is positioned on a surface of a body of water, such that the users legs are positioned over the forward section of the seat of the skier training device.

25. The method of claim 24, wherein the user is wearing the water ski device, the method further comprising positioning the water ski device on the surface of the body of water.

* * * * *